United States Patent [19]

Fukao et al.

[11] 4,346,957

[45] Aug. 31, 1982

[54] ELECTRIC CONNECTOR

[75] Inventors: Yasuyosi Fukao, Toyota; Hisaki Mayumi, Tsu, both of Japan

[73] Assignees: Tokai Electric Wire Company Limited, Yokkaichi; Toyota Jidosha Kogyo Kabushiki Kaisha, Toyota, both of Japan

[21] Appl. No.: 186,448

[22] Filed: Sep. 12, 1980

[30] Foreign Application Priority Data

Sep. 13, 1979 [JP] Japan ..... 54-127732[U]

[51] Int. Cl.[3] ..... H01R 13/60

[52] U.S. Cl. ..... 339/119 R

[58] Field of Search ..... 339/119, 120, 124

[56] References Cited

U.S. PATENT DOCUMENTS

| | | | |
|---|---|---|---|
| 2,588,288 | 3/1952 | Pohanka | 339/119 L |
| 3,177,460 | 4/1965 | Downey | 339/119 C |

FOREIGN PATENT DOCUMENTS

| | | | |
|---|---|---|---|
| 982672 | 1/1976 | Canada | 339/119 R |
| 1436699 | 3/1966 | France | 339/119 R |

*Primary Examiner*—Joseph H. McGlynn
*Assistant Examiner*—Frank H. McKenzie, Jr.
*Attorney, Agent, or Firm*—Cushman, Darby & Cushman

[57] ABSTRACT

An electric connector for connecting wires and having a clamping function for clamping a rod-shaped stationary member such as BUS wire, suitable for use in electric wiring for automobile engine or the like. The connector has a generally cylindrical connector housing, a supporting arm projected radially outwardly form the wall of the connector housing, a clamping tab integral with the supporting arm, the supporting arm and the clamping tab as a unit being cantilevered by the connector housing in such a manner that the clamping tab extends over a certain portion of the circumference of wall of the connector housing at a suitable distance from the latter, the clamping tab being provided at its surface facing the wall of the connector housing with a wire receiving recess, and at least two axial protrusions formed on the outer surface of wall of the connector housing so as to oppose to the wire receiving recess of the clamping tab and extending in the axial direction of the connector housing. The wire receiving recess of the clamping tab and the protrusions on the wall of the connector housing cooperate in clamping therebetween the BUS wire or the like stationary member so that the connector itself is stably fixed to the latter.

3 Claims, 3 Drawing Figures

ELECTRIC CONNECTOR

BACKGROUND OF THE INVENTION

The present invention relates to an electric connector for connecting electric wires and adapted to clamp a rod-shaped stationary member such as a bundle of other electric wires or a BUS line having a large diameter.

Electric circuits such as those laid in the engine room of an automobile employs numerous electric connectors. In order to prevent the mating half parts of each connector from becoming loose or disconnected from each other due to external force such as vibration, various measures have been taken to fix the connectors to stationary parts or members. For instance, the connectors are fixed to the chassis of the automobile through the aid of suitable fixing members. It is also a conventional measure to bind the connectors by cords or the like to a bundle of electric wires or a BUS line having a large diameter.

The use of specific fixing members, however, incurs an increase of number of parts resulting in a raised wiring cost. The binding by cords is also inconvenient in that it requires a complicated and time-consuming work. In addition, it is difficult to bind the connectors in the limited space which is not easy to access. Furthermore, the binding cords are often loosened due to vibration or the like reason.

Thus, the conventional fixing structures are not satisfactory from the view point of easiness and cost of the wiring.

SUMMARY OF THE INVENTION

It is, therefore, a major object of the invention to overcome the above-described problems of the prior art by providing an improved electric wire connector.

To this end, according to the invention, there is provided an electric wire connector comprising a cylindrical connector housing, a supporting arm projecting outwardly from the wall of the housing and a clamping tab extending from free end of the supporting arm over a part of the circumference of the housing with a suitable gap between itself and the wall of the housing, the supporting arm and the clamping tab as a unit being cantilevered by the wall of the housing, a wire receiving recess formed in the inner wall of the supporting tab at a portion near the free end of the latter and at least two parallel protrusions formed on the portion of the wall of housing opposing to the wire receiving recess so as to extend in the axial direction of the housing, whereby a fixed wire of the like received by the wire receiving recess is resiliently clamped by a cooperation of the clamping tab and the protrusions thereby to fix the electric connector.

The above and other objects, as well as advantageous features of the invention will become more clear from the following description of the preferred embodiments taken in conjunction with the accompanying drawings.

DESCRIPTION OF THE PREFERRED EMBODIMENTS

Figure 1:
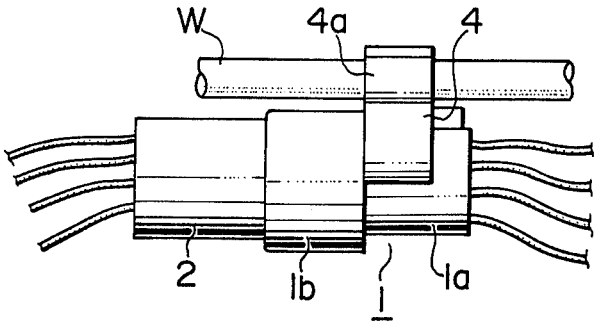
FIG. 1 is a side elevational view of an electric wire connector in accordance with an embodiment of the invention, in the state clamping a stationary BUS wire so as to be fixed by the latter.
Figure 2:
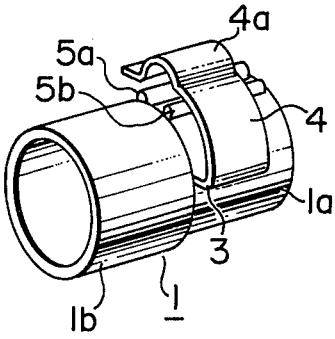
FIG. 2 is a perspective view of the electric wire connector shown in FIG. 1.
Figure 3:
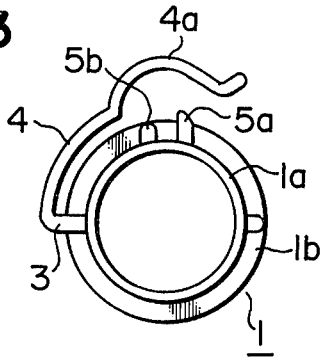
FIG. 3 is an end view of the electric connector as viewed from the right side in FIG. 1.

Referring first to FIG. 1, there is shown an electric connector constructed in accordance with an embodiment of the invention. The electric connector has a cylindrical connector housing 1 which includes a terminal accomodating portion 1*a* of a comparatively small diameter and a mating part 1*b* of a comparatively large diameter and adapted to receive a mating connector 2. The connector housing 1 having the portions of different diameters is mass-produced by molding from a synthetic resin.

The connector housing 1 has a supporting arm 3 formed on the wall of the terminal accomodating portion 1*a* to project outwardly therefrom, a clamping tab 4 integral with the supporting arm 3 and at least two protrusions 5*a*, 5*b* formed on the wall of the terminal accomodating portion 1*a*. The supporting arm 3 and the clamping tab 4 as a unit are cantilevered by the wall of the terminal accomodating portion of the connector housing 1 in such a manner that the clamping tab 4 extends over a certain portion of the circumference of the wall of the terminal accomodating portion, at a suitable radial distance from the latter. The clamping tab 4 exhibits such a resiliency that it can be flexed outwardly, i.e. away from the wall of the terminal accomodating portion by the application of an external force, but resumes the original position as it is relieved from the external force.

The clamping tab 4 is provided in its inner surface, i.e. the surface opposing the wall of the terminal receiving portion, with a wire receiving recess 4*a* in the form of a saddle. The wire receiving recess 4*a* is formed at the portion of the clamping tab near the free end of the latter. The aforementioned at least two protrusions 5*a*, 5*b* are formed on the outer peripheral surface of the wall of terminal receiving portion 1*a* at a portion of the latter opposed by the wire receiving portion 4*a* of the clamping tab 4, so as to extend in the axial direction of the connector housing 1 in parallel with one another.

In the event that only two protrusions 5*a*, 5*b* are formed, the distance between these protrusions is selected to be smaller than the diameter of the BUS wire which is to be clamped by the clamping tab 4. In the case where three or more protrusions are formed, the distance between the farthest protrusions is selected to be smaller than the above-mentioned diameter.

The protrusions may have an equal height but the protrusions 5*a*, 5*b* have different heights. More specifically, the protrusion 5*a* closest to the free end of the clamping tab 4 has a greater height than the protrusion 5*b* remoter from the same, in the illustrated embodiment. In the event that the connector housing 1 has two portions of different diameters as in the illustrated embodiment, the height of the lowest protrusion 5*b* has a height slightly greater than the diameter of the large-diameter portion, i.e. the mating portion 1*b*, of the connector housing 1.

In use, the connector housing 1 clamps the BUS wire (W) or the like rod-shaped member having a comparatively large diameter, so as to be fixed by the latter. Namely, in the illustrated embodiment, the wire receiving portion 4*a* of the clamping tab 4 and the protrusions 5*a*, 5*b* provide three-point support for the BUS wire (W) to strongly and resiliently clamp the latter.

The clamping can easily be achieved by forcibly inserting the BUS wire (W) from the free end of the clamping tab 4 into the space between the clamping tab 4 and the outer peripheral surface of the terminal accomodating portion 1*a* of the connector housing 1.

If the connector having the cylindrical form has to be fixed to a BUS wire (W) solely by the action of the clamping tab 4, it will be impossible to obtain a stable fixation because the BUS wire (W) and the connector makes contact only along a line. It is of course possible to increase the stability of fixation by increasing the rigidity of the clamping tab 4. However, the increase of the rigidity of the clamping tab 4 is naturally limited due to the reason concerning structure and will deteriorate the adaptability of the clamping tab to a large variety of diameters of the BUS wire (W). Furthermore, the resiliency of the clamping tab 4 will be lost during the use due to secular change, to deteriorate the clamping performance.

According to the invention, however, such problems are overcome for the following reasons. Namely, in the connector of the invention, the clamping tab 4 extends to surround a certain portion of circumference of the wall of housing 1, so that it can have a length large enough to provide a sufficiently large amount of deflection of the clamping tab 4 within the elasticity limit thereby to prevent the degradation of resiliency due to secular change. In addition, a stable fixation is ensured by the three-point support provided by the wire receiving recess 4*a* of the clamping tab 4 and the protrusions 5*a*, 5*b*.

Since the protrusion 5*a* closest to the free end of the clamping tab 4 has a height greater than that of the other 5*b* or others, the axis of the wire (W) is always located at the inside of the protrusion 5*a*, so that the latter provides a substantial resistance against the dropping off of the wire (W) after the clamping.

In addition, a stable three-point support is ensured because even the protrusion 5*b* having the smallest height projects above the large-diameter portion 1*b* of the housing and thus the three-point support is not obstructed by the presence of the portion 1*b*.

As will be understood from the foregoing description, according to the invention, the supporting arm 3 and the clamping tab 4 as a unit are cantilevered by the wall of the conductor housing in such a manner that the clamping tab 4 extends over a certain portion of circumference of the housing 1, so that the clamping tab 4 is allowed to have a sufficiently large length. Thus, it is possible to clamp BUS wires of a large variety of diameters at moderate resiliency, thereby ensuring a more stable clamping effect.

In addition, the provision of at least two protrusions 5*a*, 5*b* permits a stable three-point support by the cooperation of these protrusions with the clamping tab to ensure a strong and safe clamping.

Furthermore, since the clamping tab 4 can clamp the BUS wire or the like of various diameters within the elasticity limit of the material of the connector, the lowering of resiliency due to secular change is avoided and the connector can be kept clamped to the BUS wire on the like for a long period of time.

What is claimed is:

1. An electric connector comprising: a connector housing having a generally cylindrical form, a supporting arm projecting from the outer peripheral surface of the wall of said connector housing, a clamping tab integral with said supporting arm, said supporting arm and said clamping tab as a unit being cantilevered by the wall of said connector housing in such a manner that said clamping tab extends over a certain portion of the circumference of said connector housing at a suitable distance from the latter, said clamping tab being provided at its surface facing said connector housing with a wire receiving recess formed at a portion near the free end thereof, and at least two parallel protrusions formed on the outer peripheral portion of said wall of said connector housing at a portion of the latter confronting said wire receiving recess and extending in an axial direction of said connector housing, said clamping tab resiliently clamping the wire or the like rod-like member between said wire receiving recess and said protrusions.

2. An electric connector as claimed in claim 1, wherein said protrusions have different heights such that the protrusion closest to the free end of said clamping tab has a greater height than the other or others.

3. An electric connector as claimed in claim 2, wherein said connector housing has cylindrical portions of different diameters, and wherein said other protrusion or protrusions than that closest to the free end of said clamping tab has a height to slightly project above the height of the maximum diameter of said connector housing.

* * * * *